United States Patent [19]

Mean et al.

[11] 4,041,845

[45] Aug. 16, 1977

[54] HYDRAULIC ELEVATOR APPARATUS

[75] Inventors: Jean-Marie L. Mean; Joseph K. Kraft, both of Gettysburg; Leigh F. Jackson, Fayetteville, all of Pa.

[73] Assignee: Westinghouse Electric Corporation, Pittsburgh, Pa.

[21] Appl. No.: 633,999

[22] Filed: Nov. 20, 1975

[51] Int. Cl.[2] ..... F01B 11/02; B66B 11/04

[52] U.S. Cl. ..... 92/85 A; 92/85 B; 187/17

[58] Field of Search ..... 187/1 R, 9 R, 9 E, 17, 187/67, 68, 73, 8.41; 267/65 R, 127, 162; 92/85 R, 85 A, 85 B, 143; 254/89 H, 93 R, 93 L

[56] References Cited

U.S. PATENT DOCUMENTS

| | | | |
|---|---|---|---|
| 244,092 | 7/1881 | Thayer | 187/17 X |
| 531,792 | 1/1895 | Forslund et al. | 187/17 X |
| 559,526 | 5/1896 | Heermans | 187/17 X |
| 564,620 | 7/1896 | Johnson | 187/17 X |
| 963,905 | 7/1910 | Larsson | 187/17 X |
| 1,081,690 | 12/1913 | Morton | 187/17 X |
| 1,831,136 | 11/1931 | Reed | 267/65 R |
| 2,998,288 | 8/1961 | Newhouse | 92/85 A |
| 3,067,726 | 12/1962 | Williams | 92/85 A X |
| 3,267,815 | 8/1966 | Ortman et al. | 92/85 B X |
| 3,905,278 | 9/1975 | Ourdouillie | 92/85 A X |

FOREIGN PATENT DOCUMENTS

| | | | |
|---|---|---|---|
| 469,473 | 7/1937 | United Kingdom | 267/65 R |

*Primary Examiner*—John J. Love
*Assistant Examiner*—James L. Rowland
*Attorney, Agent, or Firm*—D. R. Lackey

[57] ABSTRACT

Hydraulic elevator apparatus including a cylinder and a fluid actuated plunger which supports an elevator car. A cylinder head seals against fluid leakage to the outside, and it guides the plunger as it moves relative to the cylinder. The cylinder head includes a travel limit structure for the plunger which generates a hydraulic retarding force programmed by a resilient device which adjusts the hydraulic retarding force during a travel limit stop. The resilient device also adds its own retarding force to the plunger, to smoothly decelerate and stop the plunger with minimal impact forces on the cylinder head.

12 Claims, 6 Drawing Figures

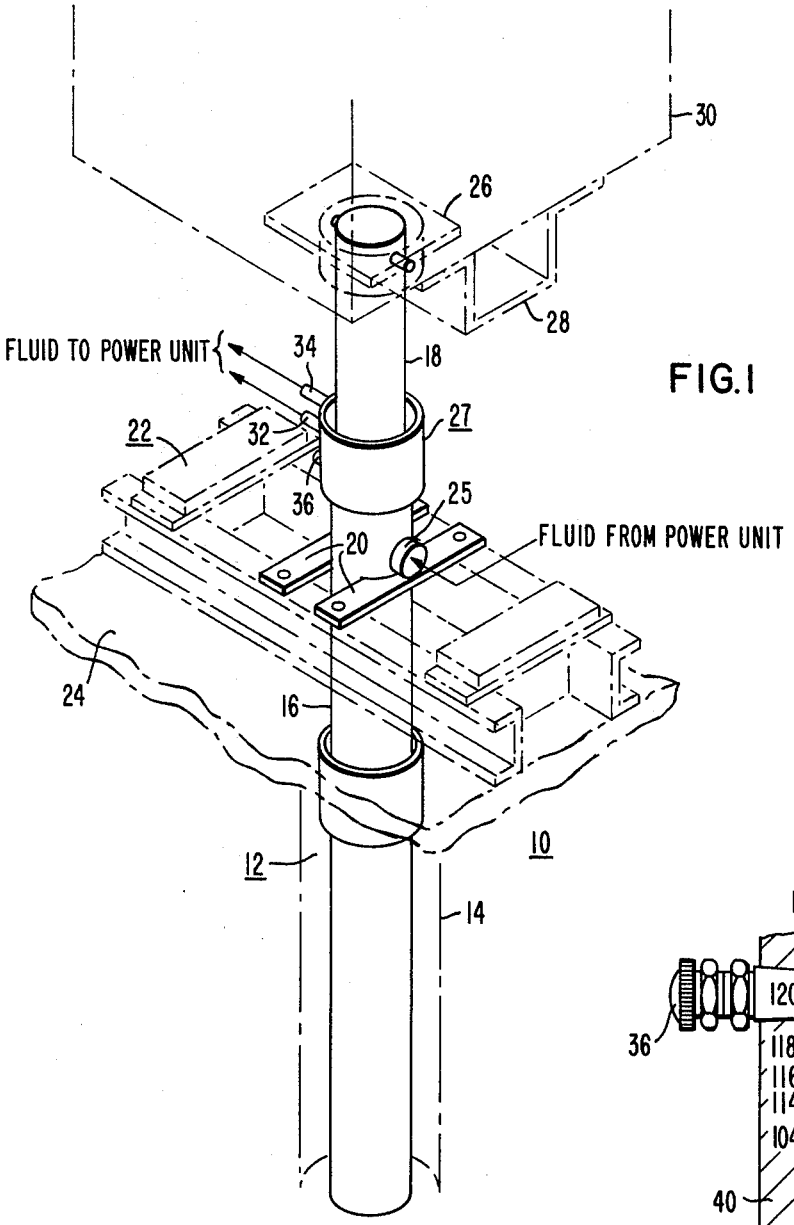
FIG.1
FIG.5
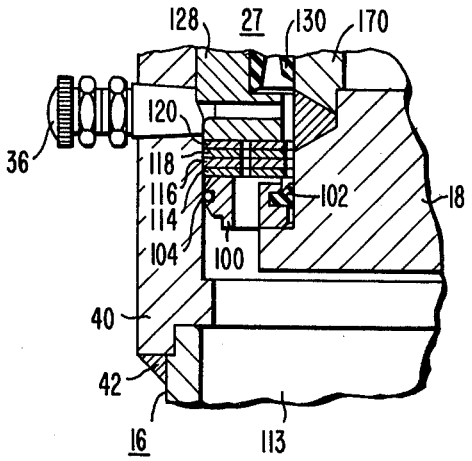
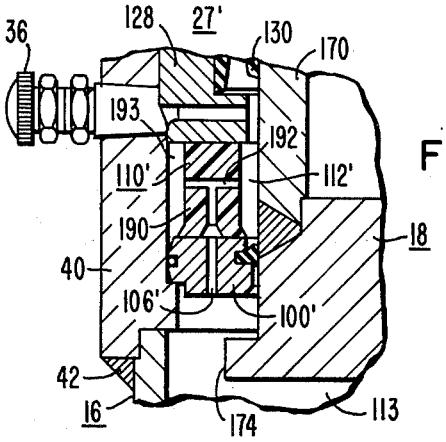
FIG.6

HYDRAULIC ELEVATOR APPARATUS

BACKGROUND OF THE INVENTION

1. Field of the Invention

The invention relates in general to hydraulic elevators, and more specifically to new and improved arrangements for stopping an elevator car of a hydraulic elevator system at an upper travel limit.

2. Description of the Prior Art

The American National Standard Safety Code for hydraulic elevators, ANSI 17.1-1971, Section 302.2e, requires that the plunger of a hydraulic elevator system be provided with solid metal stops and/or other means to prevent the plunger from overtraveling beyond the limits of the cylinder, and the stops must be designed to stop the plunger at speeds up to 100 feet per minute in the up direction without damage to the hydraulic system. Direct metal to metal contact without cushioning between a stop ring on the plunger and a cylinder head part creates very high impact forces and thus a bulky and costly cylinder head is required.

Various approaches have been taken by the prior art to lessen the impact forces at the upper travel limit of a hydraulic elevator. For example, U.S. Pat. No. 963,905 allows the plunger and cylinder to separate to enable the fluid to escape the cylinder, while maintaining a mechanical connection between the plunger and cylinder. U.S. Pat. Nos. 244,092; 559,526; and, 531,792, teach hydraulic cushions which utilize chambers and sleeves which cooperate upon overtravel to provide a cushioned stop by virtue of tapers on the chamber walls and/or sleeve. U.S. Pat. No. 564,620 provides a hydraulic cushion by an auxiliary piston which enters an auxiliary fluid chamber and forces fluid through a series of openings which are progressively closed by the auxiliary piston as it traverses the auxiliary chamber. Still other prior art structures gradually cut off the supply fluid as the travel limit is reached, such as taught by U.S. Pat. No. 1,081,690.

While these prior art structures all provide a cushioned stop, it would be desirable to provide a new and improved upper travel limit stop for hydraulic elevators which is simple in structure, facilitating the manufacture and assembly thereof, and which provides a stop in which the retarding forces on the plunger may be programmed to stop the plunger and elevator car in a predetermined travel distance with reduced impact forces on the cylinder head, permitting the size and cost of the cylinder head to be substantially reduced.

SUMMARY OF THE INVENTION

Briefly, the present invention is a new and improved hydraulic elevator apparatus which provides a smooth deceleration and stop for the plunger and elevator car at the upper travel limit by a limit arrangement which substantially reduces impact forces on the cylinder head, without requiring an excessively long travel of the plunger and car during the forced deceleration. The normal drop in the hydraulic retarding force of a hydraulic cushion is compensated for, to maintain high retarding forces on the plunger throughout the travel limit distance, and thus enable a comparatively short deceleration distance to be used. This result is obtained by utilizing a resilient member which not only adds its retarding force to the hydraulic retarding force as it is compressed, but which cooperatively programs the hydraulic retarding force by automatically reducing the degree of fluid communication between a fluid chamber provided by the resilient member in the cylinder head, and the main fluid chamber in the cylinder. When the plunger retracts, following the overtravel deceleration and stop, the resilient means returns the cylinder head parts to their normal positions to await the next overtravel of the plunger.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 1 is a perspective view, partially in phantom, of hydraulic elevator apparatus which may be constructed according to the teachings of the invention;

FIG. 5 is an elevational view, in section, of the cylinder head shown in FIG. 2, illustrating the compression of the resilient means by the plunger during a travel limit stop of the plunger; and FIG. 6 is an elevational view, in section, of the cylinder head shown in FIG. 1, constructed according to another embodiment of the invention.

DESCRIPTION OF THE PREFERRED EMBODIMENTS

Figure 2:
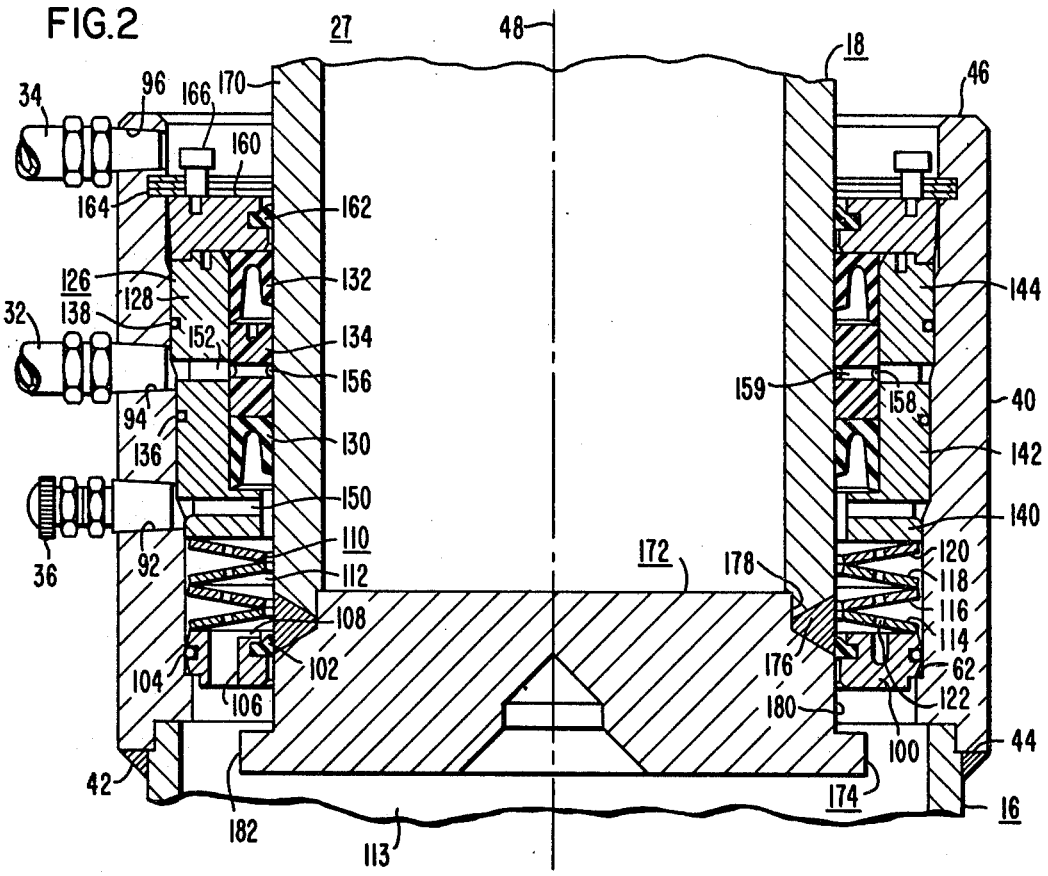
FIG. 2 is an elevational view, in section, of the cylinder head shown in FIG. 1, constructed according to a first embodiment of the invention.

Referring now to the drawings, and FIG. 1 in particular, there is shown hydraulic elevator apparatus 10 which may be constructed according to the teachings of the invention. Hydraulic elevator apparatus 10 includes a jack assembly 12 disposed in a jack hole 14. The jack assembly 12 includes a cylinder 16, usually constructed of steel pipe, and a plunger 18, which is usually formed of steel tubing. Steel load bearing brackets 20 are welded to the outside of the cylinder 16, and these brackets support the cylinder 16 on a footing channel assembly 22, shown in phantom, which is located on the floor 24 of the pit. The cylinder 16 also includes a fluid pipe inlet 25, which may be located just above the load bearing brackets 20, as illustrated, and a cylinder head 27.

The upper end of the plunger 18 includes a platen plate 26 which is fastened to a car bolster assembly 28, which is part of the supporting structure for an elevator car 30 shown in phantom. The cylinder head 27 includes a scavenger line 32, which returns fluid leakage to the power unit (not shown), an excess fluid gravity drain line 34, and an air purge valve 36. The cylinder head 27 also includes bearing means for guiding the plunger 18, and travel limit means for smoothly decelerating and stopping the plunger 18 when a predetermined travel limit is reached. The bearing means and travel limit means may be constructed according to the teachings of the invention.

Figure 3:
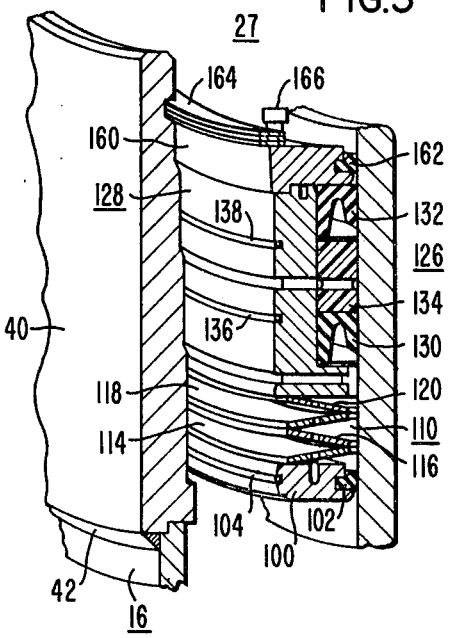
FIG. 3 is a perspective view, in section, of the cylinder head shown in FIG. 2.

More specifically, FIGS. 2 and 3 are elevational and perspective views, respectively, in section, of the cylinder head 27 shown in FIG. 1, constructed according to a first embodiment of the invention. In addition to FIGS. 2 and 3, FIGS. 4 and 5 will also be referred to when describing cylinder head 27, as they illustrate the internal wall construction of the cylinder head housing, and the operated position of the plunger travel limit means, respectively, of the cylinder head 27.

Cylinder head 27 includes a cylinder head housing 40 having first and second axial ends 44 and 46, respectively, relative to the center line or longitudinal axis 48 of the cylinder 16 and plunger 18. The first axial end 44 is attached to the upper end of cylinder 16, such as by the weld indicated at 42. In the prior art, the high impact forces applied to the cylinder head during overtravel of the plunger necessitate that the housing be cast, or formed of a heavy plated machined part. The reduced impact forces made possible by the present invention enable the cylinder head housing 40 to be formed of standard steel tubing, reducing the weight and cost of the housing, as well as the amount of machining required.

Figure 4:
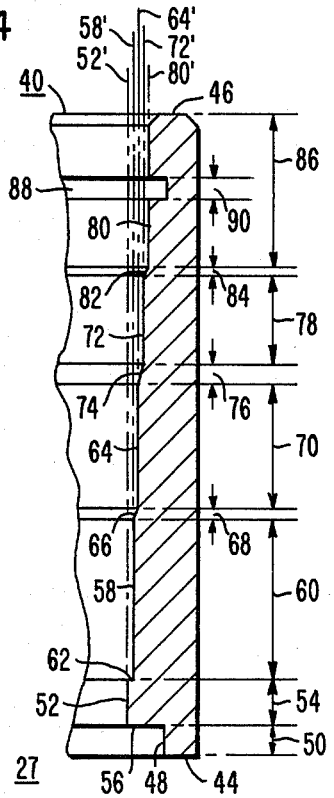
FIG. 4 is a fragmentary view of the cylinder head housing shown in FIG. 2, which more clearly illustrates the plurality of inner diameters and connecting taper portions which provide stops for the cylinder head components and which facilitate assembly without damage to the various fluid seals.

As illustrated most clearly in FIG. 4, the inside diameter of the cylinder head housing 40 is machined to provide a plurality of different internal diameters, the purpose of which will become clear as the internal construction of the cylinder head 27 is described.

Starting at the first axial end 44 of the cylinder head 27, a first inner diameter portion 48 is provided, which extends for the distance 50 between the axial ends. At the end of the first diameter portion 48, the inner wall steps inwardly to a smaller I.D. portion 52, which extends for a distance 54. The abrupt change from I.D. 48 to the smaller I.D. 52 provides a shoulder 56 against which the upper end of the cylinder 16 is butted. At the end of diameter 54, the inner wall steps outwardly to a larger I.D. 58 which extends for a distance 60. The abrupt change from I.D. 52 to the larger I.D. 58 provides a shoulder 62 which functions as a first stop for locating the assembled components of the cylinder head 27. The I.D. 58 then smoothly changes to a larger I.D. 64 via a taper 66 which extends for a short distance 68. In like manner, the I.D. 64 extends for a distance 70 and smoothly changes to a larger I.D. 72 via a taper 74 which extends for a short distance 76, and the I.D. 72 extends for a distance 78 and then changes to a larger I.D. 80 via a taper 82 which extends for a short distance 84. The I.D. 80 extends for a distance 86 to the second axial end 46 of the housing 40. A groove 88 having a short length 90 in the direction of the axis 48 is machined in the I.D. 80, for receiving a snap ring which will function as a second stop for locating the assembled components of the cylinder head 27. It will be noted that from the shoulder 62 to the groove 88 that the inner diameters progressively increase in magnitude, indicated by broken lines 52', 58', 64', 72' and 80'. Also, as illustrated in FIG. 2, the cylinder head housing 40 includes three openings 92, 94 and 96 through its side wall portion. Opening 92, which is located adjacent the taper portion 66, functions as an air bleed passage, and it receives the air purge valve 36. Opening 94 is located adjacent the taper 74 and it functions as a fluid or oil return passage, and as such, it is in fluid communication with the scavenger line 32. Opening 96 is disposed adjacent I.D. 80, between groove 88 and the second axial end 46, and it functions as a fluid or oil drain passage, and as such it is in fluid communication with the excess fluid drain line 34.

The internal components of the cylinder head 27 will be described in the order in which they are assembled during manufacture. A bottom metallic cylinder ring 100, which may be formed of steel, forms the lower end of the assembly. Its inside diameter (I.D.) is machined to provide a predetermined small clearance relative to the outside diameter (O.D.) of the plunger 18, and its O.D. is machined to provide a sliding fit with the I.D. 58 of the cylinder head housing 40. The I.D. and O.D. of the bottom cylinder ring 100 each include a circumferential groove for receiving a wiper seal 102 and an O-ring 104, respectively. The O.D. of the bottom cylinder ring 100 preferably has a double taper which starts at the O-ring groove and tapers inwardly to each edge of the ring member. This double taper prevents ring 100 from seizing during installation, and also allows the ring 100 to move up and down during operation of the travel limit structure without damage to the O-ring or danger of seizing. The wiper seal 102 and O-ring 104, as well as the elastomeric seal members to be hereinafter described, may be made of any elastomeric material suitable for the hydraulic fluid used, such as polyurethane, BUNA N, or nitrile. It will be noted that the ring 100 with its seals in place may be easily disposed in the proper position against the lower stop formed by the shoulder 62, since the inside diameters of housing 40 located above the inner diameter 58 are all larger than diameter 58. The cylinder ring 100 includes a plurality of circumferentially spaced openings or shock absorber orifices 106 disposed between the major opposed surfaces which form the axial ends of the ring 100. The surface of ring 100 which faces the second axial end 46 of housing 40 may be radially grooved from each opening 106 to the inside diameter of the ring, such as groove 108 which intersects opening 106 in FIG. 2.

Resilient means 110 is disposed above the bottom ring 100 to provide a mechanically resilient cushion or retarding force, and to also define a cavity or auxiliary fluid chamber 112 which is in fluid communication with the main fluid chamber 113 in the cylinder 16 via the plurality of shock absorber orifices 106. In the embodiment of FIGS. 2, 3 and 5, the resilient means includes a plurality of metallic spring members. The number of spring members used depends upon the diameter of the cylinder, with four spring members 114, 116, 118, and 120, being shown for purposes of example. Spring members 114, 116, 118 and 120 are generally washer-shaped, having the form of a dished disc with an open center, such as Belleville springs. Regardless of the number of spring members, they are oppositely oriented such that the outer edge of lowest spring member i.e., spring member 114 contacts the upper surface of ring 100. This orientation of the lowest spring member permits free or unrestricted fluid communication between the main chamber 112 and the auxiliary chamber 113 via openings 106. The inner edge of the next spring member 116 contacts the inner edge of spring member 114, the outer edge of spring member 118 contacts the outer edge of spring member 116, and the inner edge of spring member 120 contacts the inner edge of spring member 118. The outside diameter of the spring members is selected to allow the spring members to slide into position adjacent I.D. 58 and to be biased to a flat position when operated, without interference with the surface of I.D. 58. The inner diameters of the spring members are slightly larger than the O.D. of the plunger 18, to provide a fluid path between their inner edges and the plunger 18. While not absolutely essential, a plurality of circumferentially spaced small openings, such as opening 122 in spring member 114, may be provided in each of the spring members, which openings extend between their major opposed surfaces. For purposes of illustration, the openings 122 are illustrated in the figures as being in alignment with one another from one spring member to the next, but in practice they will not be aligned, except by accident. The functioning of the plunger travel limit arrangement provided by the lower ring 100 and the resilient means 110, will be hereinafter described.

A seal assembly 126, including a metallic, cylindrical, seal housing 128, and main and back-up plunger seals 130 and 132, respectively, bearing and gland 134, and O-ring seals 136 and 138, is disposed adjacent the upper end of I.D. 58, taper 66, I.D. 64, taper 74, and I.D. 72, of the cylinder head housing 40. The outside surface of the seal housing 128 is stepped to match the inner diameters of the cylinder head housing 40.

More specifically, housing 128 includes a portion 140 adjacent its lower axial end, as viewed in FIG. 2, having an O.D. which is a sliding fit with I.D. 58, an intermediate portion 142 which has an O.D. which is a sliding fit with the I.D. 64, and a portion 144 adjacent its upper axial end having an O.D. which is a sliding fit with I.D. 72. The outer surfaces of portions 142 and 144 include circumferential grooves for receiving the O-ring members 136 and 138, respectively. The inside diameter of seal housing 128 adjacent the lower axial end is slightly larger than the O.D. of plunger 18, and then the I.D. becomes larger to provide a shoulder for receiving the main seal 130. The latter mentioned I.D. is constant to the second axial end of the seal housing, to enable the bearing and gland 134 and the back-up seal 132 to be accommodated.

The lower portion 140 of seal housing 128 includes one or more openings through its side wall portion, such as opening 150, which opening enables air in the system to be collected and purged through the air purge valve 36. One or more openings, such as opening 152, are also provided through the side wall portion, located between portions 142 and 144, to enable leakage fluid collected by the seal 132 to be returned to the power unit via the scavenger line 32.

The seal assembly 126 will easily slide into position without damaging the O-rings due to the different I.D.'s of the cylinder head housing and the smooth tapers between them, and the different I.D.'s also provide positive stops which prevent the seal housing from advancing beyond the desired position in the direction towards the first axial end 44 of the cylinder head 27.

The main seal 130, which is an elastomeric member similar to the upper seal 132 prevents the fluid contained in the cylinder 16 from leaking as the plunger 18 moves up and down through the cylinder head. Any fluid leakage through this seal is collected by the upper seal 132 and returned to the power unit 152 through the seal housing 128 and scavenger line 32.

The bearing and gland 134 is constructed according to the teachings of the invention, to combine the plunger guiding and gland functions. The bearing and gland 134 is a cylindrical member formed of a suitable bearing material, such as one of the laminated plastics formed of a plurality of layers of cloth impregnated with a resin which will not be attacked by the hydraulic fluid, or a soft metal, such as babbit or bronze. The bearing and gland 134 has inside and outside diameters sized to snugly but slidably accommodate the plunger 18 and the adjacent I.D. of the seal housing. Circumferential grooves 156 and 158 on the inside and outside surfaces, respectively, of the guide and gland 134, along with a plurality of fluid openings 159 which interconnect the grooves 156 and 158, provide the functions of collecting fluid leakage past the main seal, and directing the fluid to the scavenger line 32.

Seal 132 is a back-up or reservoir seal, similar or identical in construction to the main seal 130, which will prolong the useful operating life of the seal assembly 126.

An upper or top cylinder ring 160 is placed over the seal assembly 126. Ring 160 has its I.D. sized to provide a predetermined small clearance with plunger 118, and its I.D. is grooved to receive a wiper seal 162, which is similar or identical to wiper seal 102. As illustrated in FIG. 2, the O.D. of ring 160 is slightly tapered, starting at a maximum O.D. at its upper axial end, and tapering smoothly inwardly to a minimum O.D. at its lower axial end. This taper prevents the ring 160 from seizing during assembly.

A spiral type snap ring 164 is placed into the groove 88 disposed in the I.D. of the cylinder head housing 40, which snap ring rests against the upper axial end of the upper ring 160 and takes the reduced impact forces which will be transmitted through the cylinder head during a plunger travel limit stop. A plurality of locking or shoulder screws 166 are threadably engaged with the upper axial end of the ring 160, to maintain the snap ring 164 in the desired position in groove 88. Instead of using the snap ring 164 to provide the upper stop function, it would also be suitable to thread the outer surface of ring 160, thread the I.D. of the cylinder head housing 40 adjacent the second axial end 46, and to threadably engage the ring 160 with the threaded end of the cylinder head 27.

The plunger 18 includes a cylindrical pipe or tubing 170, with the lower end thereof sealed by a plunger plug 172. The plunger plug 172, which includes a stop ring portion 174, is preferably welded to the end of the pipe 170, with the weld being indicated at 176. The plunger plug 172 has three machined outside diameters 178, 180 and 182, with the smallest diameter 178 fitting inside the pipe 170, the second diameter 180 matching the outside diameter of the pipe 170, allowing the location of the weld 176 to be spaced from the stop ring sufficiently for ease in grinding the final O.D., but not far enough to contact the main seal 130, and the third diameter 182 provides the stop ring function.

In the normal operation of the cylinder head 27, the hydraulic fluid, such as oil, which is in the main fluid chamber 113 communicates freely with the auxiliary fluid chamber 112 in the cylinder head 27 via the shock absorber orifices 106 disposed through ring 100. If the plunger 18 overtravels in the up direction, the plunger stop ring 174 contacts the bottom ring 100 and carries it upwardly against the bias of the resilient means 110. The resilient means 110 acts as a shock absorber of the impact forces, with the retarding force on the plunger due to the spring members increasing with displacement as the springs are flattened. Also, since the volume of the auxiliary fluid chamber 112 is reduced as the resilient means 110 is compressed, a hydraulic retarding force is also applied to the plunger. This hydraulic retarding force is normally highest at the initial contact, or shortly thereafter, and would normally drop rapidly, requiring a relatively long chamber to provide the desired retarding effect without high impact forces in the cylinder head. A long overtravel of the plunger 18, however, is undesirable. The present invention slows down the decrease in hydraulic retarding force by utilizing the resilient means to progressively reduce the degree of fluid communication between the auxiliary fluid chamber 112 and the main fluid chamber 113. In the embodiment of FIG. 2, the bottom spring 114 slowly closes the main entrances to the openings 106 as it is flattened, and when it is completely flattened, the only fluid communication between the chamber is through the grooves 108, if grooves 108 are used. In some applications the grooves 108 are unnecessary. The small openings 122 in the spring members, if used, provide fluid communication between the various parts of the auxiliary fluid chamber defined by the spring members. The amount of the hydraulic retarding force is programmed by the spring member 114 as it flattens, with the magnitude of the hydraulic retarding force versus percentage of spring displacement depending upon the size and number of orifices 106 disposed through the ring member 100. The increasing mechanical retarding force provided by the spring members, and the programmed hydraulic retarding force which is maintained at a higher than normal level by the action of the spring member closing the orifices 106, cooperate to smoothly decelerate and stop the plunger 18 with substantially reduced impact forces in the cylinder head. FIG. 5 illustrates the operated position of the resilient means 110 during a travel limit stop of the plunger. When the plunger 18 is stopped and retracted, the resilient means 110 returns to its unstressed configuration, and the lower ring 100 is moved back to its original position against shoulder 62. The travel limit stop is not an inflexible metal to metal contact of the stop ring against a fixed member of the cylinder head, resulting in a reduction in the impact forces to such a degree that the cylinder head housing 40 may be formed of standard steel tubing having an O.D. less than one inch larger than the cylinder O.D. In addition to reducing the material content of the cylinder head, the machining which is required is also reduced.

While the metallic spring members 114, 116, 118, and 120 are the preferred implementation of the resilient means 110, the resilient means 110 may be formed of an elastomeric material, such as illustrated in FIG. 6. FIG. 6 illustrates a cylinder head 27', which is similar to cylinder head 27, except for a modified travel limit means. Unmodified components in the cylinder head 27' are given the same reference numerals as in the other figures, while modified components are given the same reference numerals and a prime mark.

More specifically, in the FIG. 6 embodiment the only components which are modified are the ring 100' and the resilient means 110'. The ring 100' is modified to provide the number and size of shock absorber orifices 106' which are required to operate with the modified resilient means 110'. The resilient means 110' is modified to provide a self-centering elastomeric ring member 190, which has a plurality of openings 192 disposed to communicate with the shock absorber orifices 106' and allow free passage of the hydraulic fluid between the auxiliary fluid chamber 112' and the main fluid chamber 113'. Elastomeric ring member 190 may be made self-centering by providing a plurality of circumferentially spaced fins or protrusions 193 on its outer surface. Elastomeric ring member 190 may be formed of any suitable elastomeric material which has the desired chemical resistance to the hydraulic fluid, and which will provide the desired retarding forces as it is compressed between the lower end of the seal housing and the lower ring 100, during a travel limit stop of the plunger.

The programming of the hydraulic retarding force is accomplished in the FIG. 6 embodiment by the collapsing of the fluid passages 192 through the elastomeric ring member 190 as it is compressed. When a travel limit stop has been completed and the plunger retracts, the elastomeric ring member will return to its unstressed configuration and cause the ring member 100 to return to its normal position.

In summary, there has been disclosed new and improved hydraulic elevator apparatus which uniquely performs the required travel limit stop of the elevator car and plunger should the normal travel limit of the car in the upward direction be exceeded. This travel limit function is provided by a cylinder head construction which cooperates with the plunger stop ring to greatly reduce impact forces in the cylinder head and thus enable the bulk and cost of the cylinder head to be substantially reduced. In addition to the combination of mechanical and programmed hydraulic retarding forces on the plunger provided by the disclosed travel limit means in the cylinder head, the cylinder head construction has been further simplified by eliminating the need for a separate guide bearing and a separate gland. The guide and gland functions have been combined into a single structure which performs both functions.

We claim as our invention:

1. Elevator apparatus, comprising:

an elevator car, a jack including a cylinder having a main fluid chamber and a fluid actuated plunger which supports said elevator car, said cylinder including a cylinder head having limit means for cooperating with the plunger to stop the plunger at a predetermined travel limit, said limit means including a first end member having fluid openings therein, and resilient means, said first end member and said resilient means cooperating to provide an auxiliary fluid chamber in fluid communication with said main fluid chamber, said plunger stressing said resilient means as it nears said predetermined travel limit to reduce the volume of said auxiliary fluid chamber and force fluid therefrom into said main chamber via the fluid openings in said first end member, said resilient means reducing the degree of fluid communication between said auxiliary and main fluid chambers as it is stressed to provide a hydraulic retarding force which cooperates with the resilient retarding force of the resilient means to smoothly decelerate and stop the plunger with reduced impact forces on said cylinder head.

2. The elevator apparatus of claim 1 wherein said resilient means includes a metallic, dished, open center disc member which closes the fluid openings in the end member as it is stressed by the plunger.

3. The elevator apparatus of claim 1 wherein said resilient means includes a plurality of stacked, metallic, dished, open center disc members which are oppositely oriented across the stack, with one of the disc members being in contact with the end member, said contacting disc member at least partially closing the fluid openings in the first end member as it flattens under the influence of the plunger.

4. The elevator apparatus of claim 1 wherein the plunger carries a stop ring which contacts and axially advances the end member to stress the resilient means, said resilient means returning the end member to its starting position when the plunger retracts.

5. The elevator apparatus of claim 1 wherein said resilient means includes an elastomeric member having fluid openings therein which cooperate with the fluid openings in the end member to provide fluid communication between the main and auxiliary fluid chambers, said fluid openings in said elastomeric member collapsing as the elastomeric member is stressed, to reduce the degree of fluid communication between the main and auxiliary fluid chambers.

6. The elevator apparatus of claim 1 wherein the cylinder head includes seal means disposed to seal against fluid leakage, and bearing means for guiding the plunger, said bearing means being disposed immediately adjacent the seal means, between the seal means and the open end of the cylinder head, said bearing means being configured to provide bearing surfaces for the plunger and fluid passages for collecting fluid leakage through the seal means.

7. The elevator apparatus of claim 1 wherein the cylinder head includes first and second axially spaced seal members disposed to seal against fluid leakage, and bearing means for guiding the plunger, said bearing means being disposed between said first and second seal members, said bearing means being configured to provide bearing surfaces for the plunger and fluid passages for collecting fluid leakage through a seal member.

8. Elevator apparatus, comprising:

an elevator car, a jack including a cylinder having a main fluid chamber, and a fluid actuated plunger which supports said elevator car, said cylinder including a cylinder head, said cylinder head including a cylindrical housing having first and second axial ends, with the first axial end being secured to an end of the cylinder, first and second end members adjacent the first and second axial ends respectively of the housing, first seal means including a seal housing, an auxiliary fluid chamber between said seal housing and said first end member, and resilient means, said resilient means being disposed in said auxiliary fluid chamber, said seal housing extending from said resilient means to said second end member, said first end member having fluid openings therein which provide fluid communication between the main fluid chamber and said auxiliary fluid chamber in the cylinder head, said plunger contacting and advancing the first end member towards the second end member against the bias of the resilient means as the plunger nears a predetermined travel limit, said resilient means reducing the degree of fluid communication between the auxiliary and main fluid chamber as it is stressed to provide a hydraulic retarding force which cooperates with the resilient retarding force of the resilient means to smoothly decelerate and stop the plunger with reduced impact forces on said cylinder head.

9. The elevator apparatus of claim 8 wherein the inside of the cylindrical housing of the cylinder head has a plurality of different diameters, starting adjacent the first axial end and progressively increasing in diameter towards the second axial end, second seal means disposed between the first end member and the adjacent surface of the cylinder housing, and third seal means disposed between the seal housing and the adjacent inner surface of the cylindrical housing, said different inside diameters of the cylindrical housing limiting axial movement of the seal housing and second end member towards the first axial end of the cylindrical housing while facilitating assembly of the first end member and seal housing without damage to said second and third seal means.

10. The elevator apparatus of claim 9 wherein the first end member includes a circumferential groove on its outer surface for accommodating the second seal means, with the outer surface tapering inwardly from the groove to both edges thereof, and the second end member includes a single taper on its outer surface which starts with a maximum diameter on its axial end of the second end member which is adjacent to the second axial end of the cylindrical housing, and tapering to a minimum diameter on the axial end of the second end member which faces the first axial end of the cylindrical housing.

11. The elevator apparatus of claim 8 wherein the first seal means includes first and second axially spaced elastomeric seal members disposed between the seal housing and the plunger, and guide means in the space between the first and second elastomeric seal members which guides the plunger.

12. The elevator apparatus of claim 10 wherein the guide means includes fluid openings for collecting fluid which leaks past the elastomeric seal located on the cylinder side of the guide means.

* * * * *